United States Patent [19]

Ferren

[11] Patent Number: 4,875,852

[45] Date of Patent: Oct. 24, 1989

[54] LAMP DEVICE

[76] Inventor: Robert C. Ferren, 602 Fifth Ave. South, Altoona, Iowa 50009

[21] Appl. No.: 176,721

[22] Filed: Apr. 1, 1988

[51] Int. Cl.[4] ..... F23D 3/18

[52] U.S. Cl. ..... 431/324; 431/320; 362/180; 362/181

[58] Field of Search ..... 431/302, 311, 320, 323, 431/324; 362/161, 163, 180, 181

[56] References Cited

U.S. PATENT DOCUMENTS

| | | | |
|---|---|---|---|
| 545,401 | 8/1895 | Arwood et al. . | |
| 978,990 | 12/1910 | Damon . | |
| 2,790,317 | 4/1957 | Bowers | 431/323 |
| 3,171,398 | 3/1965 | Lawson . | |
| 3,994,672 | 11/1976 | Novak | 431/324 X |
| 4,608,011 | 8/1986 | Comstock . | |
| 4,728,286 | 3/1988 | Olsen | 362/181 X |

*Primary Examiner*—Margaret A. Focarino

*Attorney, Agent, or Firm*—Zarley, McKee, Thomte, Voorhees & Sease

[57] ABSTRACT

An improved lamp device is disclosed having a fuel reservoir consisting of a metal top and plastic bottom with a wick extending upward from the reservoir. A shell surrounds the reservoir and is removably attached to the fuel reservoir so that the fuel reservoir may be pulled from the bottom of the support and the amount of fluid observed through the plastic portion of the reservoir. The device may include a hollow rod surrounding the wick, and hollow tube at the top of the wick to collect excess fuel.

10 Claims, 1 Drawing Sheet

LAMP DEVICE

BACKGROUND OF THE INVENTION

This invention relates to a lamp device. One problem with maintaining lamp devices, especially the small types of lamps used in a restaurant, is the continual maintenance and refilling of the fuel associated with them. It is frequently difficult, if not impossible, to determine when the fuel is low unless a lamp goes out, and refilling and cleaning can be messy and dangerous.

Further, most such lamps must have their fuel reservoirs inserted from the top of the lamp. This means that either only a small reservoir with a small fuel capacity can be used if a small globe is desired, or a large undesirable globe fitting a large opening must be used if a larger reservoir is used.

Accordingly, it is an object of the present invention to provide for an improved lamp device with easy maintenance.

Another object is to provide for a lamp device wherein the amount of fuel contained in it may be readily ascertained.

Another object of the invention is to provide for quick and convenient removal or insertion of the fuel cannister through the bottom of the lamp device.

Still another object is to provide for the upper glass portion to be separately removed for cleaning.

A further object of the invention is to provide for collection of excess fuel which may travel up the wick, and returning it to the fuel cannister.

A further object is to provide for improved ventilation within the lamp device.

SUMMARY OF THE INVENTION

In accomplishing the above objectives, the present device employs a fuel cannister which is in two parts. The upper part is metal, and the lower part is plastic. Attached to the fuel cannister is a support, and the cannister may be removed from beneath this support, and the amount of fuel easily seen through the plastic portion, and readily replaced. The upper glass enclosure is separately placed within the support so that it may be independently removed. A wick is contained within an elongated rod extending from the fuel reservoir up through the upper portion of the fuel cannister. A hollow tube is held in place around the tip portion of the rod and wick by an attaching means, and the hollow tube provides ventilation, and collects excess fuel which may travel up the wick.

DETAILED DESCRIPTION OF THE INVENTION

Figure 1:
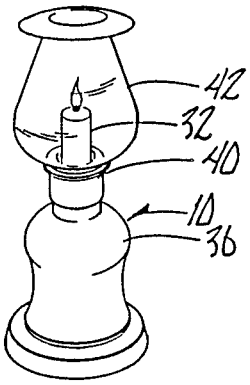
FIG. 1 is a perspective view of the lamp device in operation.

The lamp device is generally represented at 10 and contains a fuel reservoir 12 which consists of a bottom cup part 14 and a top part 16. The bottom cup part 14 is made of a plastic, and is translucent or transparent so that the amount of fuel contained in the bottom part 14 can be easily seen. The top part 16 further consists of a reduced diameter portion 18. The bottom part 14 includes a reduced-diameter shoulder 19 for fitting within the top part 16.

Figure 2:
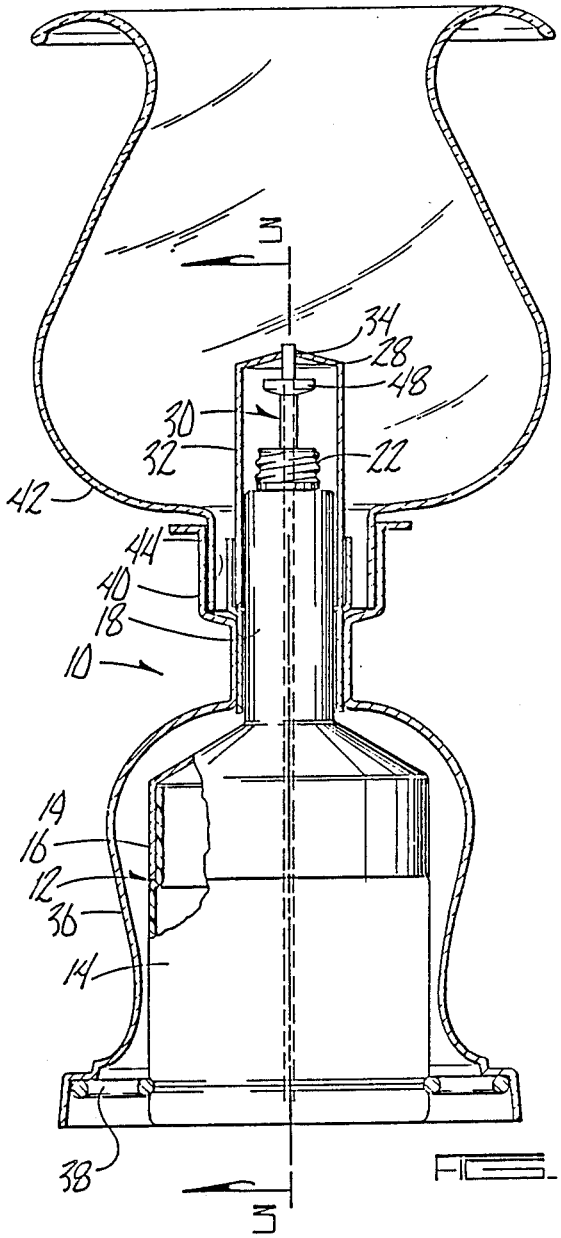
FIG. 2 is an enlarged scale vertical cross-sectional view of the lamp device of FIG. 1.

At the uppermost portion of top part 16 is a threaded neck portion 20. Neck portion 20 receives a threaded cap 22 (FIG. 2) having a central hole 24 through which wick 26 passes. Wick 26 is slidably mounted with hollow elongated brass rod 28. The wick 26 extends from the bottom part 14 containing the fluid up through the top part 16 and through the neck 20. The wick 26 is contained within a hollow brass rod 28. The hollow brass rod 28 likewise extends from the bottom part 14 through the neck 20 in the top part 16. Hollow tube 30 is frictionally mounted within hole 24 of cap 22 and extends upwardly therefrom.

The wick 26 and hollow brass rod 28 pass through the hole in the screw cap 22, and through the center of the hollow tube 30 and thence upwardly from the hollow tube 30.

Sleeve 29 (FIG. 2) embraces the reduced diameter portion 18 of top part 16. Placed over the hollow tube 30, screw cap 22, and top part 16 of the fuel reservoir 12, is a cap or snuffer 32 which is mounted within the upper end of sleeve 29. The snuffer 32 has in its center portion at the top a hole 34. The wick 26 and hollow brass rod 28 extend through this hole 34.

Outside of the fuel reservoir 12 is a shell 36. The shell 36 may take any number of a variety of shapes, or decorative outer appearance. The shell 36 is connected at its lower portion to the lower end of the bottom part 14 of the fuel reservoir 12 by any one of a number of means, and in this case a sealing ring 38 is depicted as securing the shell 36 to the fuel reservoir 12. In this manner, the fuel reservoir 12 may be pulled from the bottom of the shell 38, and the contents checked for the amount of fuel, or fuel can be replenished.

At the upper part of the shell 36 is a flange 40. It is adapted to accept an upper shell, which ordinarily takes the form of a glass globe 42. The glass globe 42 surrounds the top part 16 of the fuel reservoir 12, and encases the flame. The globe 42 includes an elongated bottom portion 44 which in this embodiment is shown fitting within the flange 40 of the shell 36.

Figure 3:
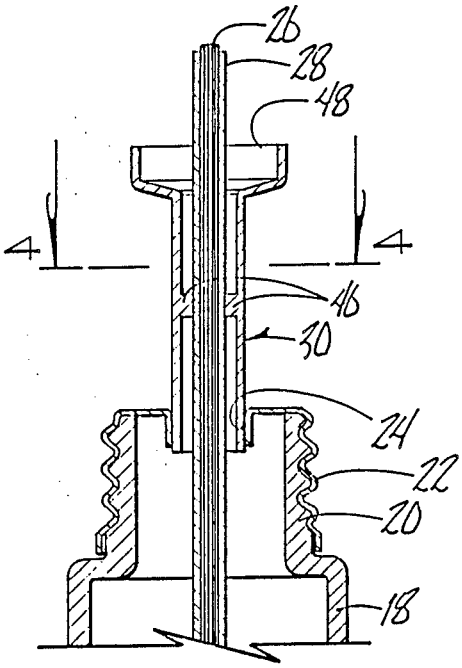
FIG. 3 is a cross-sectional view of the upper portion of the lamp device, taken along line 3—3 of FIG. 2.

FIG. 3 shows details of the upper portion of the lamp device 10. The hollow tube 30 is held in place by the screw cap 22, and support is also provided to the wick 26 and hollow brass rod 28 by an elongated middle portion 46 of the hollow tube 30. An upper cup-shaped portion 48 is shown in this embodiment of the invention. This assists in collecting fuel when an excess of amount of fluid travels up the wick, and allows this excess fuel to be returned to the fuel reservoir 12 through the airways 50. The airways 50 also provide for ventilation of the interior part of the lamp device 10.

Figure 4:
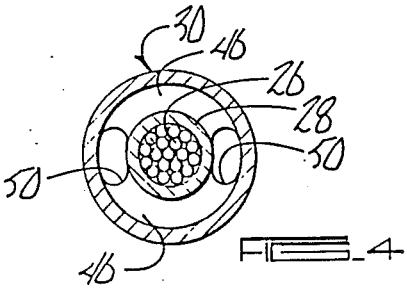
FIG. 4 is a cross-sectional view along line 4—4 of FIG. 3 looking down into the tip portion of the lamp device.

FIG. 4 shows a cross-sectional view which further depicts the arrangement of the wick 26, brass rod 28, hollow tube 30, and the airways 50.

Thus, it can be seen that the lamp 10 may be checked to determine the amount of fuel by lifting lamp 10, pulling the fuel reservoir 12 from shell 36 and releasing the engagement of sealing ring 38 with the shell 36 and fuel reservoir 12. The amount of fuel remaining may be easily determined by looking through the plastic bottom cup part 14 of fuel reservoir 12. Fuel is easily replenished by removing plastic bottom 14 from top portion 16 and either refilling or replacing bottom 14. The two piece asembly of fuel reservoir 12 allows for a translucent plastic bottom portion while the top portion may be made of metal or material resistant to heat. It also provides ease in refilling.

In addition, a small lamp globe can be used to enhance the decor of the lamp without limiting the capacity of the fuel reservoir, since the reservoir is inserted through the bottom of the lamp, and not through the top.

Further, the wick 26 is held in place by the hollow brass rod 28, and as fuel travels up the wick 26, any excess fuel collecting at the top of wick 26 is allowed to collect in hollow tube 30, and pass back to fuel reservoir 12 via airways 50. Airways 50 also allow for aeration of the lamp 10.

Since the globe 42 includes elongated bottom portion 44 and slides easily into flanges 40 provided on shell 36, the glass globe may also be separately removed for cleaning or replacement.

It can be seen from the disclosure that a number of variations may be contemplated and still fall within the scope of the invention.

What is claimed is:

1. A lamp device comprising:

a fuel reservoir, said reservoir comprising a bottom cup means and a metal top, said cup means being of translucent plastic material and having a bottom, a continuous side wall, and an open top, said metal top closing said open top and extending upwardly therefrom and terminating in a reduced diameter portion;

a wick extending downwardly through said metal top into said fuel reservoir;

a shell means having an open top and bottom, and side wall removably secured to and surrounding said fuel reservoir so that said fuel reservoir may be removed through the bottom of said shell;

said bottom of said fuel reservoir being visually accessible whereby when said fuel reservoir is removed through the bottom of said shell, any fluid in said reservoir is visible through the bottom of said fuel reservoir.

2. The device of claim 1 wherein said shell is removably secured to said fuel reservoir by a supporting means contacting the bottom of said fuel reservoir, and the bottom of said shell.

3. The device of claim 3 wherein said supporting means is a sealing ring.

4. The device of claim 1 further comprising a flange on the top of said shell; a globe having an open top, an open bottom, and continuous side walls, removably matingly associated with said flange and extending upward from said shell.

5. The device of claim 4 wherein said globe is comprised of glass.

6. The device of claim 1 further comprising a hollow rod surrounding said wick, having an upper portion extending up from said top portion of said fuel reservoir and a lower portion extending downwardly into said fuel reservoir.

7. The device of claim 6 further comprising a hollow tube secured to the top of said fuel reservoir and surrounding a top portion of said hollow rod, wherein said hollow tube collects excess fluid from said wick.

8. The device of claim 7 wherein said hollow tube is secured to the top of said fuel reservoir by a screw cap.

9. The device of claim 7 further comprising an elongated cap, having a top with a hole therethrough, an open bottom and continuous side walls, said elongated cap placed over said wick in the top of said fuel reservoir; said wick and said hollow rod passing through the hole in the top of said cap.

10. The device of claim 4 wherein the open top of said shell is substantially smaller than the open bottom thereof, whereby a substantially large fuel reservoir can be inserted through said open bottom while a relatively small globe having a relatively smaller open bottom can be mounted on the open top of said shell.

* * * * *